US008721469B2

(12) United States Patent
Snyder

(10) Patent No.: US 8,721,469 B2
(45) Date of Patent: May 13, 2014

(54) GOLF CLUB, GOLF CLUB HEAD AND GOLF CLUB GRIP STRUCTURES

(75) Inventor: Jeremy N. Snyder, Benbrook, TX (US)

(73) Assignee: Nike, Inc., Beaverton, OR (US)

( * ) Notice: Subject to any disclaimer, the term of this patent is extended or adjusted under 35 U.S.C. 154(b) by 165 days.

(21) Appl. No.: 12/900,604

(22) Filed: Oct. 8, 2010

(65) Prior Publication Data

US 2011/0111879 A1 May 12, 2011

Related U.S. Application Data

(60) Provisional application No. 61/258,085, filed on Nov. 4, 2009.

(51) Int. Cl.
*A63B 53/14* (2006.01)

(52) U.S. Cl.
USPC ..... 473/300

(58) Field of Classification Search
CPC . A63B 59/0029; A63B 59/0092; A63B 53/14
USPC ..... 473/300–303
See application file for complete search history.

(56) References Cited

U.S. PATENT DOCUMENTS

| | | | | | |
|---|---|---|---|---|---|
| 1,890,037 | A * | 12/1932 | Johnson | 473/300 |
| 5,261,665 | A * | 11/1993 | Downey | 473/303 |
| 5,322,290 | A * | 6/1994 | Minami | 473/201 |
| 5,358,249 | A | 10/1994 | Mendralla | |
| 5,634,859 | A | 6/1997 | Nesbitt | |
| 5,944,617 | A * | 8/1999 | Falone et al. | 473/300 |
| 6,110,059 | A * | 8/2000 | Haggarty | 473/387 |
| 6,464,090 | B1 * | 10/2002 | Martinez | 211/70.2 |
| 6,923,356 | B2 * | 8/2005 | Reynolds | 224/585 |
| 7,186,189 | B2 * | 3/2007 | Huang | 473/300 |
| 7,458,903 | B2 * | 12/2008 | Wang et al. | 473/300 |
| 7,549,232 | B2 * | 6/2009 | Tadin | 33/515 |

(Continued)

FOREIGN PATENT DOCUMENTS

| | | |
|---|---|---|
| GB | 2264062 | 8/1993 |
| GB | 2 291 358 | 1/1996 |

(Continued)

OTHER PUBLICATIONS

International Search Report and Written Opinion for PCT Application No. PCT/US2010/052625 dated May 4, 2011.

(Continued)

*Primary Examiner* — Stephen L. Blau
(74) *Attorney, Agent, or Firm* — Banner & Witcoff, Ltd.

(57) ABSTRACT

Golf club, golf club head and/or golf club grip structures include portions formed of a recycled regrind material. For instance, a golf club head, such as a putter head, may include a ball striking surface at least partially formed of regrind. In some examples, the golf club grip, such as a putter grip, may be at least partially formed of the recycled regrind material. For example, the grip may have an interior grip portion formed of regrind to provide a firm, sturdy grip structure, and it may include an exterior portion wrapped around the interior grip portion and formed of a softer material. In other examples, portions of the exterior surface of the grip may be formed of regrind while other portions may be formed of a different material that may, in some examples, be softer than the regrind.

21 Claims, 11 Drawing Sheets

(56) References Cited

U.S. PATENT DOCUMENTS

| | | | | |
|---|---|---|---|---|
| 7,566,375 | B2 * | 7/2009 | Huang | 156/63 |
| 7,862,446 | B2 * | 1/2011 | Huang | 473/300 |
| 8,273,845 | B2 * | 9/2012 | Meltzer et al. | 528/74.5 |
| 8,435,133 | B2 * | 5/2013 | Huang | 473/300 |
| 2005/0054497 | A1 * | 3/2005 | Hull | 482/110 |
| 2006/0252571 | A1 * | 11/2006 | Wang | 473/300 |
| 2007/0243949 | A1 | 10/2007 | Solari | |
| 2007/0287551 | A1 * | 12/2007 | Wang et al. | 473/300 |
| 2010/0234127 | A1 | 9/2010 | Snyder et al. | |

FOREIGN PATENT DOCUMENTS

| | | |
|---|---|---|
| JP | 05-065364 | 8/1993 |
| JP | 2007000411 | 11/2007 |
| WO | 2005065787 | 7/2005 |
| WO | 2006010092 | 1/2006 |
| WO | 2007141637 | 12/2007 |

OTHER PUBLICATIONS

Extended EP Search Report dated May 31, 2013 from EP Application No. 13153489.3.

English translation of Korean Office Action dated Apr. 22, 2013 form Application No. 10-2012-7012269.

Japanese Office Action (with English translation) dated Nov. 14, 2013 for JP Application No. 2012-537893.

* cited by examiner

GOLF CLUB, GOLF CLUB HEAD AND GOLF CLUB GRIP STRUCTURES

CROSS REFERENCE TO RELATED APPLICATIONS

This application claims priority to U.S. Provisional Application No. 61/258,085, entitled "Golf Club, Golf Club Head and Golf Club Grip Structures," filed Nov. 4, 2009, the content of which is incorporated herein by reference in its entirety.

FIELD OF THE INVENTION

The present invention relates generally to golf clubs, golf club heads and/or golf club grip structures. Particular example aspects of this invention relate to golf clubs, such as putters, having a portion of the club head formed of a recycled material, and/or a portion of the grip formed of a recycled material.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.). Also, individual club head models may include multiple variations, such as variations in the loft angle, lie angle, offset features, weighting characteristics (e.g., draw biased club heads, fade biased club heads, neutrally weighted club heads, etc.). Club heads may be combined with a variety of different shafts, e.g., from different manufacturers; having different stiffnesses, flex points, kick points, or other flexion characteristics, etc.; made from different materials; etc.). Between the available variations in shafts and club heads, there are literally hundreds of different club head/shaft combinations available to the golfer.

Despite recent technological advances in golf equipment, putting remains a difficult portion of the game for many golfers. Putting requires golfers to perform a number of independent tasks, consider information relating to a number of different variables, and then combine the results of these tasks and analyses into a physical golf stroke. More specifically, first, the golfer must "read" the green to determine the desired speed at which to propel the ball and the desired direction to propel the ball. These features are dependent on one another in that a given putt generally may be propelled at a variety of different speeds and in a variety of different directions. Certain combinations of speed and direction (particularly over sloped terrain, like most golf greens) will result in successfully putting the ball into the hole. For example, a putt hit in a first direction may miss the hole (by going "above" the hole or "below" the hole) at a first speed, but a putt propelled in the same direction at a different speed (or within a relatively narrow range of speeds) may go into the hole. Similarly, a putt may be hit within a range of different directions, provided the golfer properly adjusts the putt's speed for the specific direction hit. After reading the green (e.g., considering its "slope") and deciding on a line and speed, the golfer then must physically hit the ball with the putter in the desired direction at the desired speed. Deviations in any of these judgments or execution may lead to missed putts.

Golfers tend to be sensitive to the "feel" of a golf club, particularly with respect to putters. The "feel" of a golf club comprises the combination of various component parts of the club and various features associated with the club that produce the sensory sensations experienced by the player when a ball is swung at and/or struck. Club "feel" is a very personal characteristic in that a club that "feels" good to one user may have totally undesirable "feel" characteristics for another. Club weight, weight distribution, aerodynamics, swing speed, and the like all may affect the "feel" of the club as it swings and strikes a ball. "Feel" also has been found to be related to the visual appearance of the club and the sound produced when the club head strikes a ball to send the ball in motion.

While technological improvements to golf club designs have been made, because of the very personal nature of the putter stroke and the "feel" aspects of putting a golf ball, no single putter structure is best suited for all players. New putter structures that change the look and feel of the club are welcomed by at least some players.

SUMMARY OF THE INVENTION

Aspects of this invention relate to golf club, golf club head and golf club grip structures. In some examples, the golf club, golf club head and/or golf club grip may include a portion formed of a recycled regrind material. For instance, a golf club head may include a ball striking surface formed in a front face of the golf club head. In some examples, the ball striking surface (or at least a portion thereof) may be formed of a recycled regrind material.

Other aspects of this invention relate to golf club grips structures, such as putter grips. The putter grips may be formed of multiple materials, one such material being a recycled regrind material. In some arrangements, the putter may include an interior grip portion formed of a recycled regrind material and an exterior grip portion formed of a material having a lower Shore hardness value and thus having a softer feel than the interior grip portion. The exterior grip portion may form all, or substantially all, of the exterior grip surface contacted by a user during play.

In still other arrangements, the grip may include various regions formed throughout the grip surface. The regions may be formed of one or more materials, including a recycled regrind material. In some arrangements, the recycled regrind material may form regions of the grip in which contact with a user is minimized.

BRIEF DESCRIPTION OF THE DRAWINGS

The present invention is illustrated by way of example and not limited in the accompanying figures, in which like reference numerals indicate similar elements throughout, and in which.

Figure 1A:
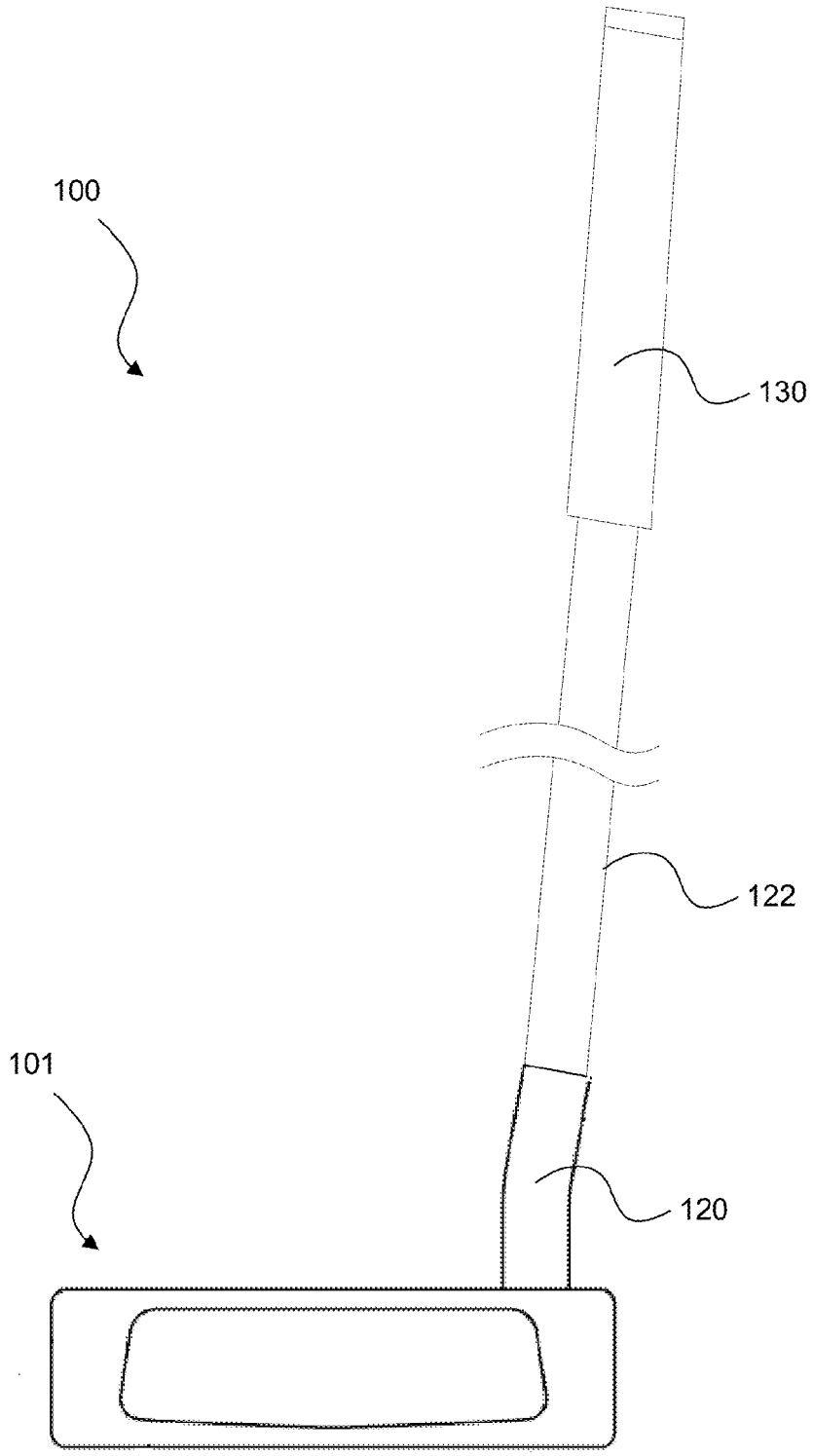
FIG. 1A is a front view of an example golf club according to at least some examples of this invention.

The reader is advised that the various parts shown in these drawings are not necessarily drawn to scale.

DETAILED DESCRIPTION

The following description and the accompanying figures disclose features of golf club, golf club head and golf club grip structures in accordance with examples of the present invention.

I. General Description of Example Golf Club, Golf Club Head, and Golf Club Grip Structures in Accordance with this Invention Some aspects of this invention relate to golf club heads. In some examples, the golf club heads may include a golf club head body having a front face, a rear, a toe and a heel. The golf club head may further include a ball striking surface forming a portion of the front face of the golf club head body, the ball striking surface including at least a portion formed from a regrind material softer than the remainder of the front face of the golf club head body. In some examples, the entire ball striking surface may be formed of regrind material.

Other aspects of this invention relate to golf club grips that may include a first grip layer forming a base for the golf club grip, the first grip layer being formed of a recycled regrind material. The golf club grips may further include a second grip layer surrounding the first grip layer. In some examples, the second grip layer may be arranged on an exterior surface of the first grip layer and may form an exterior surface of the golf club grip. The second grip layer may be formed of a second material that is newly manufactured (e.g., not recycled or regrind) and may have a lower Shore hardness value than the recycled regrind material. In some examples, the material of the first grip layer may have a Shore hardness value that is at least 10% higher than the Shore hardness value of the material of the second (or other) grip layers, and in other examples, the material of the first grip layer may have a Shore hardness value at least 15% higher, or even at least 20% higher than other of the second (or other) grip layers.

Still other aspects of this invention relate to golf club grips that may include a top region, a bottom region and a central region extending between the top region and the bottom region. The golf club grips may further include a first grip region forming a first portion of the central region. In some examples, the first grip region may be formed of a first material and may form a majority of a surface of the central region. In at least some examples, the golf club grips may further include a second grip region within the central region. The second grip region may be formed of a second material different from the first material, wherein the second material is a recycled regrind material. This material may be newly manufactured, as described above.

Yet other aspects of this invention relate to golf clubs that may include a golf club head having a front face, a rear, a toe and a heel. In at least some examples, the front face may include a ball striking surface formed of a first material different from the material forming the remainder of the golf club head. In some arrangements, the golf club head may further include a shaft connected to the golf club head. The shaft may include a golf club grip arranged at an end opposite the golf club head. In at least some examples, the grip may include a first grip region formed of the first material and a second grip region formed of a second material different from the first material and different from the material forming the remainder of the golf club head. In at least some arrangements, the first material may be a recycled, regrind material.

Given the general description of various example aspects of the invention provided above, more detailed descriptions of various specific examples of golf clubs and golf club head structures according to the invention are provided below.

II. Detailed Description of Example Golf Club, Golf Club Head, and Golf Club Grip Structures According to the Invention The following discussion and accompanying figures describe various example golf club, golf club head and golf club grip structures in accordance with the present invention. When the same reference number appears in more than one drawing, that reference number is used consistently in this specification and the drawings to refer to the same or similar parts throughout. It is understood that embodiments other than those shown in the accompanying figures may be utilized and modifications may be made without departing from the scope of the present invention.

FIG. 1A illustrates an example golf club 100 in accordance with at least some aspects of this invention. The golf club 100 shown is a putter-type golf club. However, various aspects of this invention may be used with a variety of golf club types, including wood-type golf clubs, hybrid golf clubs, iron-type golf clubs, utility clubs, and the like. Nothing in the specification should be viewed as limiting the invention as described herein to putter-type golf clubs.

Golf club heads may generally include a plurality of different regions, segments, portions, ends, etc. In an example embodiment, a golf club head may generally include a front face, a rear, a toe, a heel, a crown and a sole. The golf club 100 generally includes a golf club head 101 connected to one end of a shaft 122. The shaft 122 may be formed of conventional materials such as steel, graphite, composite materials, and the like. The golf club 100 may further include a grip 130 connected to an opposite end of the shaft 122. The grip 130 may be formed from various materials, as will be discussed more fully below, and may be connected to the shaft 122 using known methods of connection, such as adhesives, tape, cements, mechanical connectors, and the like.

Figure 1B:
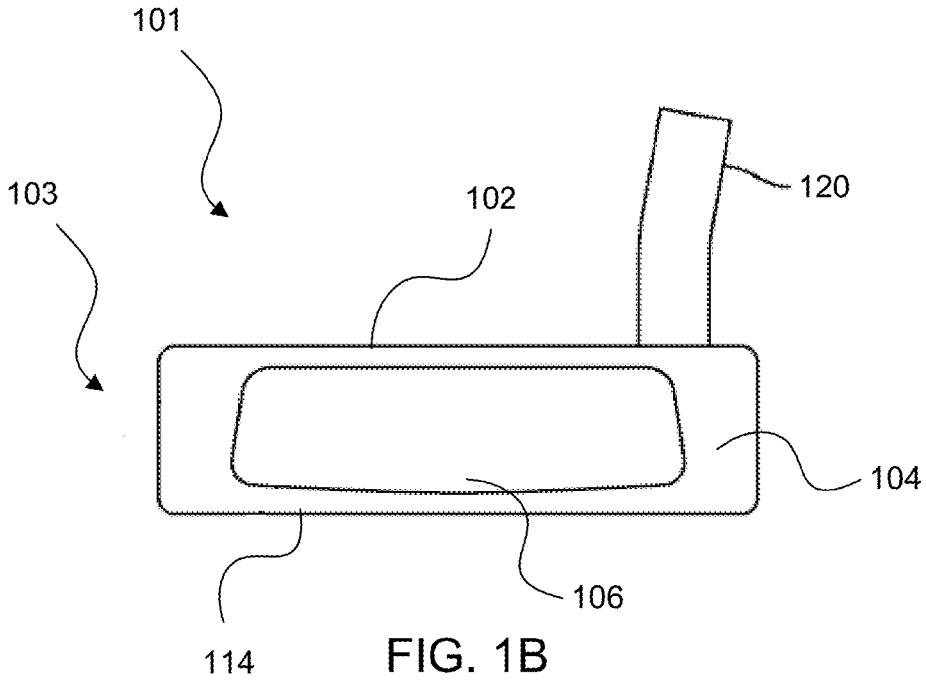
FIG. 1B is a front view of the golf club head of FIG. 1A generally illustrating features of golf club head structures according to at least some examples of this invention.
Figure 1C:
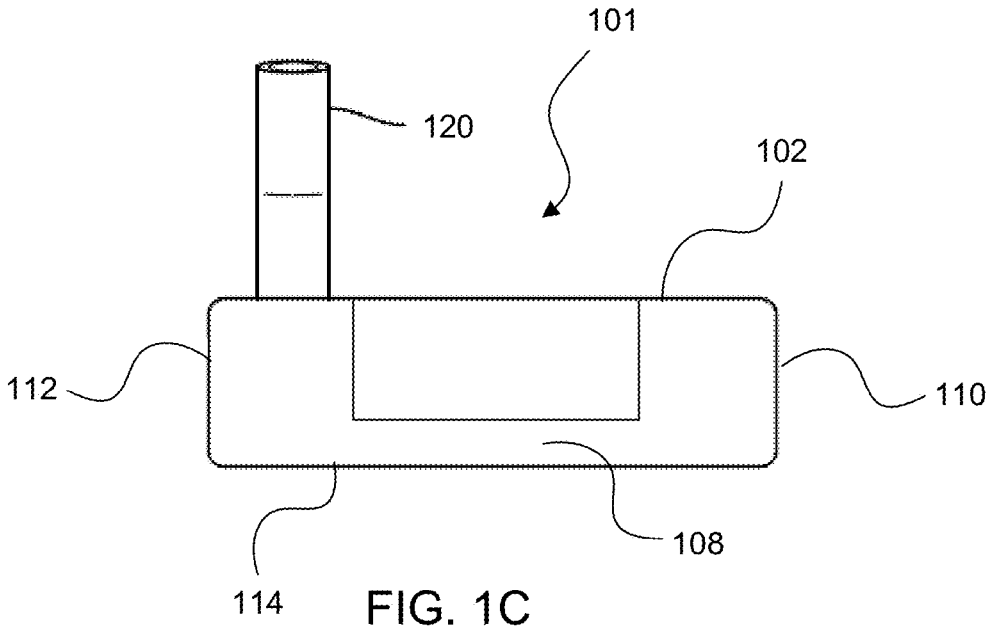
FIG. 1C is a rear view of the example golf club head of FIG. 1A generally illustrating features of golf club head structures according to at least some examples of this invention.

FIGS. 1B and 1C illustrate front and rear views, respectively, of an example golf club head structure 101 that may be produced in accordance with aspects of this invention. As shown in FIGS. 1B and 1C, the golf club head 101 may include a club head body 103 that may have a top 102, a front face 104 including a ball striking surface 106, a rear 108, a toe 110, a heel 112 and a bottom or sole 114. Further, the golf club head 101 may include a hosel 120 formed to, among other things, facilitate connection of the golf club head 101 to the shaft 122. The shaft 122 may be engaged with the club head body 103 in any desired manner, such as via cements or adhesives; via threaded or other mechanical connectors; via welding, brazing soldering, or other fusing techniques; etc. The hosel 120, shaft 122 and/or club head body 103 may be made from any desired number of parts and/or any desired materials, including from conventional parts, conventional materials, and in conventional constructions as are known and used in the art.

As mentioned above, front face 104 may include a ball striking surface 106 configured for striking a golf ball. The ball striking surface 106 may be made from a different material than the remainder, or a portion of the remainder, of the club head body 103. For instance, the ball striking surface 106 may be formed from a material softer than the remainder of the club head body 103 (i.e., having a lower Shore hardness value), such as a polymeric material, recycled material such as regrind, and the like. The softer material may also be more lightweight than the material forming the remainder of the golf club head 101. In some arrangements, the ball striking surface 106 may be formed integrally with and/or completely constitute the front face 104. In other arrangements, the ball striking surface 106 may comprise an insert that is formed separately from the front face 104 and may be connected to a recess defined in the front face 104, as will be described more fully below.

In some examples, the ball striking surface 106 may include any of a variety of features, configurations, shapes, surfaces and details. For example, ball striking surface 106 may include a series of grooves or other textures that facilitates travel of the golf ball when the ball striking surface 106 impacts a golf ball. Spacing, size, depth, shape, contour and orientation of these grooves may be varied to provide varied characteristics, as will be discussed more fully below. Also, ball striking surface 106 may be formed of a softer or harder material or may be treated to strengthen or soften the material in anticipation of the ball striking surface 106 repeatedly being used to impact the golf ball. By varying the hardness of some of the material, the feel of the golf club head may be varied. For example, it may be desirable to have a softer ball striking surface 106 compared to the other surfaces of the golf club head. In contrast, it may be desirable for a ball striking surface of a driver or iron-type club to have a hardened hitting surface 106. Many other forms of surface treatments and ornamentation may be incorporated into the ball striking surface 106, from hardened materials to holes, grooves, and corrugation and various other hitting surface materials, structures and configurations, as will be discussed more fully below.

As mentioned above, in some examples, the ball striking surface 106 may be formed of a material different from the remainder of the club head and/or may include an insert portion that may be formed of a material different from the remainder of the golf club head. For instance, the ball striking surface 106 may be formed of a material softer than the remainder of the golf club head 101 in order to provide a softer feel when using the putter and/or to provide a more true roll. In some arrangements, the ball striking surface 106 may be formed, at least in part, from a polymeric material including recycled materials, such as regrind. In some examples, the regrind may include additives used in the formation of the ball striking surface 106 that may include finely ground recycled materials. In some examples, the finely ground recycled materials may be recycled footwear materials that may be scraps, shavings, etc. generated during manufacture, defective or used articles of footwear, and the like. The additives may include leather, cotton, thermoplastics, synthetic and natural rubber, millable/partially cross-linked polyurethane, and synthetic fibers. The thermoplastics may include polyamides, polyesters and polyurethanes.

Figure 2A:
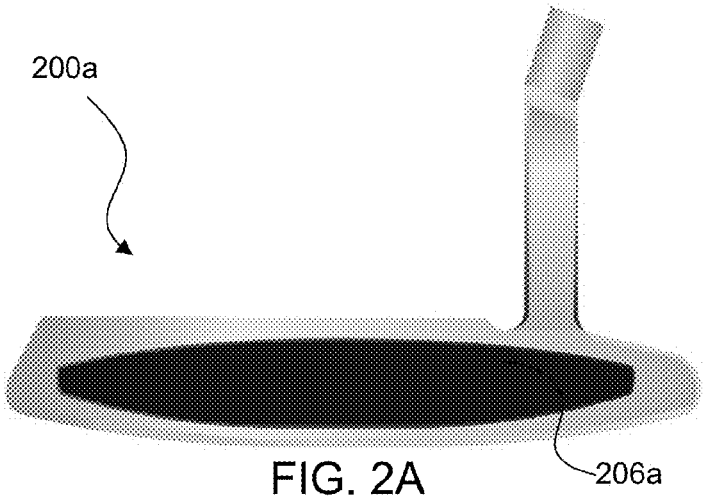
FIGS. 2A-2C illustrate example golf club heads according to at least some examples of this invention having a ball striking surface formed of a material different from the remainder, or a portion of the remainder, such as a recycled material.
Figure 2B:
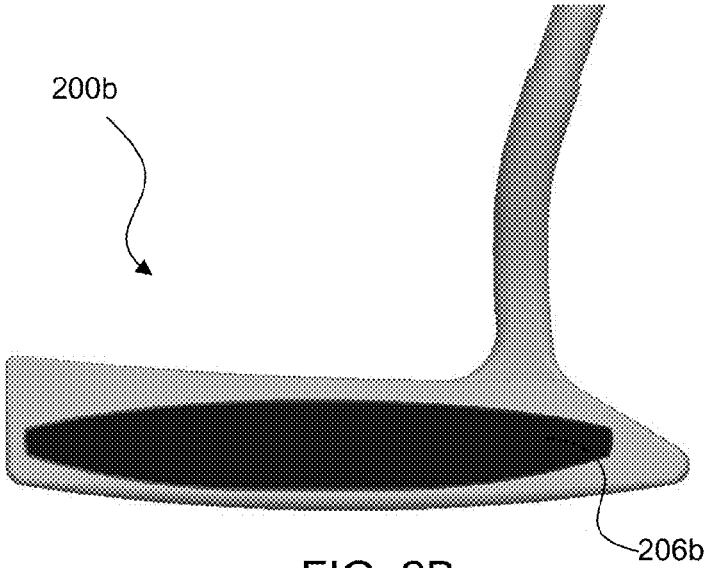
Figure 2C:
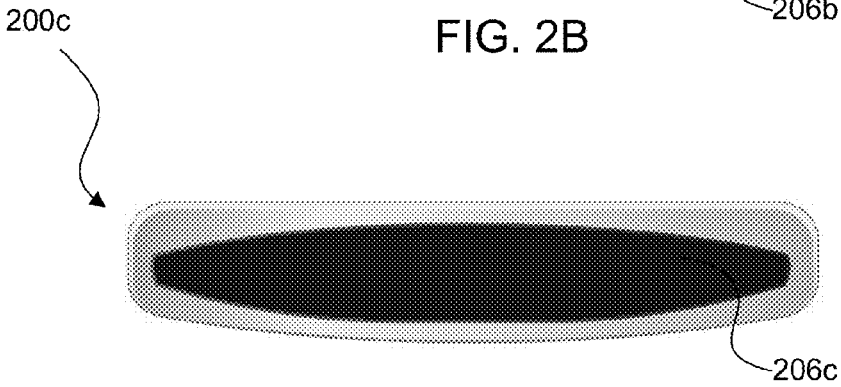

In some examples, the regrind additives may be ground to a desired particle size and added to raw material (such as new polymeric material) to form the ball striking surface 106. In other instances, the ball striking surface 106 may be formed entirely of regrind material. FIGS. 2A-2C illustrate some example golf club heads having ball striking surfaces formed at least in part from regrind materials. As shown, the golf club heads 200*a*-200*c* may vary in shape, size, configuration, etc. The ball striking surface 206*a*-206*c* may also vary in shape, size, configuration, etc. For instance, in some examples, the ball striking surface 206*a*-206*c* may comprise a majority of the front face of the golf club head 200*a*-200*c*.

Additionally or alternatively, the ball striking surface 206*a*-206*c* may be an insert formed separately from the remainder, or a portion of the remainder, of the golf club head 200*a*-200*c*, or it may be integrally formed with the golf club head 200*a*-200*c*. In instances in which the ball striking surface 206*a*-206*c* is an insert formed separated from the golf club head 200*a*-200*c*, the insert may be connected into a recess formed in the golf club head 200*a*-200*c* using known adhesives (such as VHV tape), cements, epoxys, and the like. Alternatively, if desired, the recess may be omitted and/or the ball striking surface 206*a*-206*c* may project away from a backing support surface structure thereof.

One advantage of using regrind materials in forming the ball striking surface is the reduction in waste associated with the manufacture of the articles being ground into regrind and the reduction in first-use materials in manufacturing the ball striking surface. The use of recycled materials generally reduces waste that would have consumed landfill space and aids in reducing the carbon footprint of manufacturers. Additional examples of regrind materials, manufacture, etc. may be found in U.S. Pat. No. 5,346,934 to Chriss, entitled "Footwear Additive Made From Recycled Materials," which is incorporated herein by reference in its entirety.

With further reference to FIGS. 1A through 1C, the golf club head 100 may be commonly referred to as a golf club head for a putter. Putters are configured for hitting or putting a golf ball on a "green" or other like surfaces upon which a golfer may putt a golf ball. Generally, a putter head 101 is formed and shaped to cause a ball to be rolled along a generally smooth surface when a ball is properly struck by the club. In some examples, the golf club head 101 may be selectively and purposefully weighted in a predetermined manner. For instance, one or more portions of the golf club head 101 or club head body 103 may include weighted or denser portions to advantageously distribute weight at desired locations on the golf club head 101. In some examples, the weighting may be accomplished by having material, such as a heavier or lighter material than the remainder of the golf club head 101, dispersed throughout the material at specific locations of the golf club head 101, or it may be accomplished utilizing one or more regions of heavier or lighter material placed or inserted in specific locations. The weighting of the golf club head may help facilitate the stroke of the putter and may aid in allowing a smoother and more accurate putt (e.g., by increasing the club head's moment of inertia (particularly Izz, the moment of inertia through the club head center of gravity in the vertical direction with the club head in a ball address orientation)). Therefore, the weighting of the golf club can be balanced in manners to place the center of mass at certain locations to provide a preferred stroke and contact with the golf ball.

Putters may vary greatly in their shape, size and appearance. Although a generally rectangular head putter is shown in FIGS. 1A through 1C, other putter head shapes and arrangements may be used in accordance with aspects of this invention, such as elongated shapes, substantially square, round, oval, etc. head putters, two-ball shaped putters, blade type putters, mallet type putters, oversized or heavy putters, and the like. Additionally or alternatively, the golf club head 101 may include cut-outs, bulges, spherical structures, channels and various other configurations that facilitate alignment and/or weighting of the club. In particular, causing a center of mass of the putter head to be aligned with a preferred, central ball striking spot on the ball striking surface 106 may be desirable in many instances.

FIGS. 3A-3E illustrate one example grip 330 for a golf club, such as golf club 100. Although the grip 330 may be described as being used with a putter, the grip arrangements described herein may be used with any type of golf club, including at least wood-type golf clubs, iron-type golf clubs, hybrid golf clubs, and the like. The grip 330 may include multiple layers or portions. For instance, the grip 330 may include an interior grip member (332, shown in isolation in FIG. 3B) and an exterior grip member 334. The interior grip member 332 may include a top portion 336 and a bottom portion 337 that are optionally exposed in the final grip construction, the bottom portion being configured to transition between the grip 330 and the shaft (not shown). In addition, the interior grip member 332 may include a central region 333 to which the exterior grip portion 334 may be connected, as will be discussed more fully below. If desired, either or both of the interior grip member 332 and the exterior grip member 334 may be made from multiple pieces without departing from this invention.

In some examples, the interior grip member 332 and the exterior grip member 334 may be formed of different materials. For instance, the interior grip member 332 may be formed of a material harder (i.e., having a greater Shore hardness value) than the exterior grip member 334. Thus, the harder interior grip member 332 may aid in providing a firm, sturdy structure for the grip, which may aid in ease of installation on a shaft, as well as providing a substantial structure during play. Further, the softer exterior grip member 334 may provide a comfortable grip for the portion of the grip 330 being contacted by the user during play.

Figure 3A:
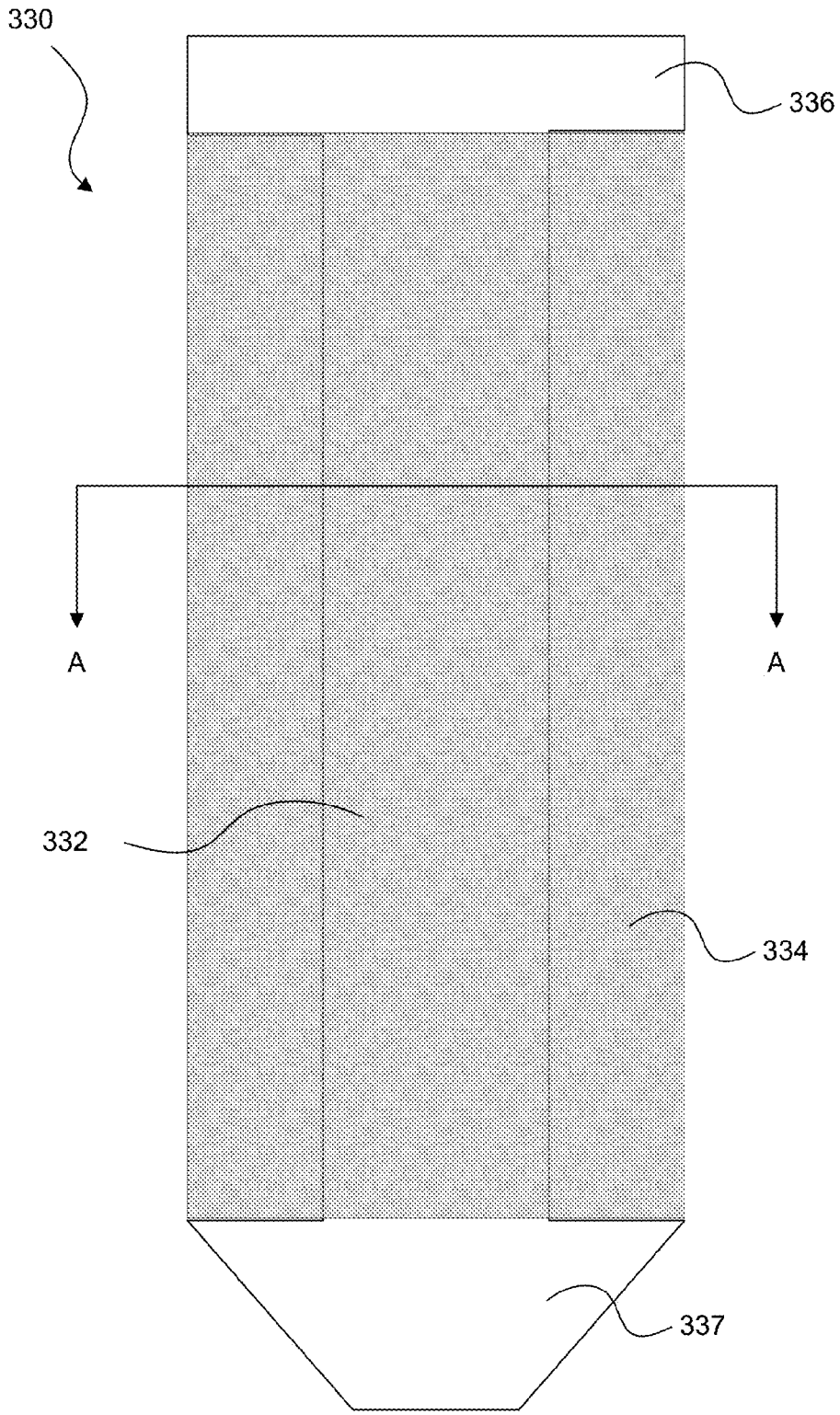
FIG. 3A illustrates one example golf club grip formed of multiple materials according to at least some examples of this invention.
Figure 3B:
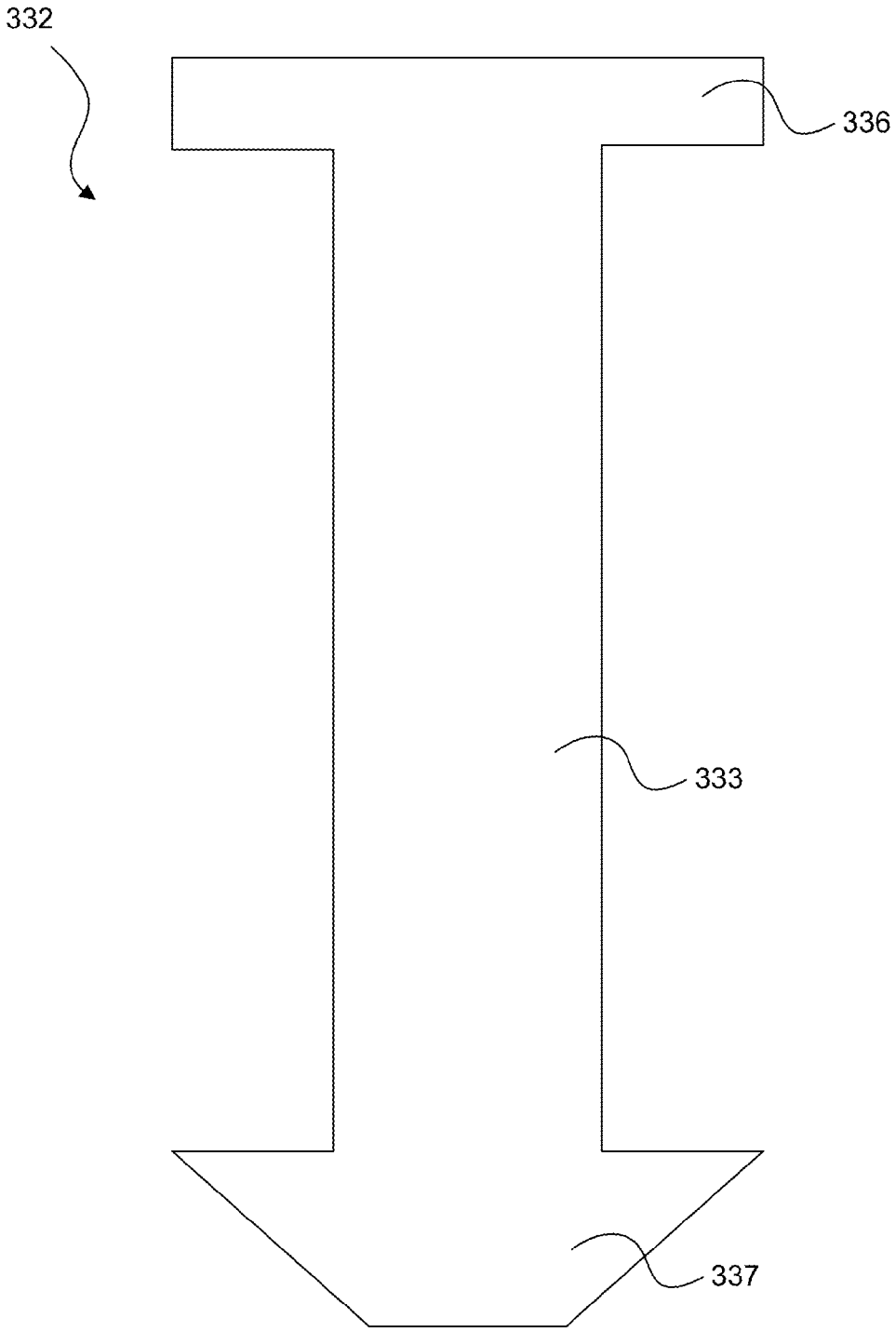
FIG. 3B is a front view of an interior grip portion of the grip of FIG. 3A that may be formed of a material different from the exterior grip portion according to at least some examples of this invention.
Figure 3C:
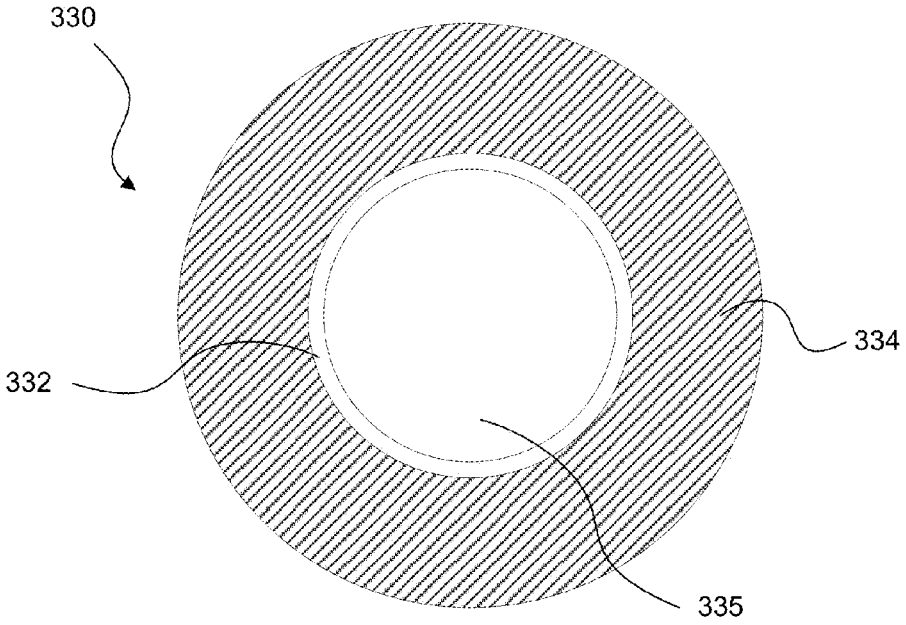
FIG. 3C is a cross-sectional view of the grip of FIG. 3A taken along line A-A and illustrating the grip being formed of multiple materials according to at least some examples of this invention.

In some arrangements, the grip 330 may be a "wrap grip" arrangement. That is, the interior grip member 332 provides a harder foundation for the exterior grip member 334 that may be wrapped around the interior grip portion 332. FIG. 3C is a cross-sectional view of the grip 330 taken along line A-A in FIG. 3A. The interior grip member 332 is shown surrounding a center aperture 335 into which the shaft (not shown) of the golf club may extend for attachment. The harder interior grip member 332 of this specific example structure is generally configured to not be in contact with the user during play (although, as noted above, the end portions 336 and 337 may be exposed). Instead, the exterior grip member 334 surrounds the vast majority of the interior grip member 332 to provide a soft, comfortable grip surface for a user. The various parts of the grip may be engaged together in any desired manner, including conventional manners that are known and used in the art for multi-material grips, such as via adhesives or cements, via embedding procedures, via mechanical connectors, etc.

In some arrangements, the thickness of the exterior grip member 334 may be constant along the grip 330. For instance, in some arrangements, the thickness of the exterior grip member 334 may be approximately 0.1 to 1.5 inches (as measured radially outward from the interior grip portion 332 to the exterior surface of the exterior grip member 334), although other thicknesses are possible. In some other examples, the thickness of the exterior grip member 334 may vary along the length of the grip 330 or interior grip portion 332 (e.g., to provide a tapered structure). For instance, in regions having substantial contact with the hands of the player, the thickness of the exterior grip member 334 may be increased to provide further cushioning and/or comfort to the user. However, in regions of the grip 330 in which user contact is minimal (such as at a bottom of the grip 330) the thickness of the exterior grip member 334 may be decreased to conserve use of materials, reduce cost associated with manufacture, etc. The thickness of the interior grip member 332 along the main axial extent thereof may in a range of, for example, 0.1 to 1.5 inches, although other thicknesses are possible.

Figure 3D:
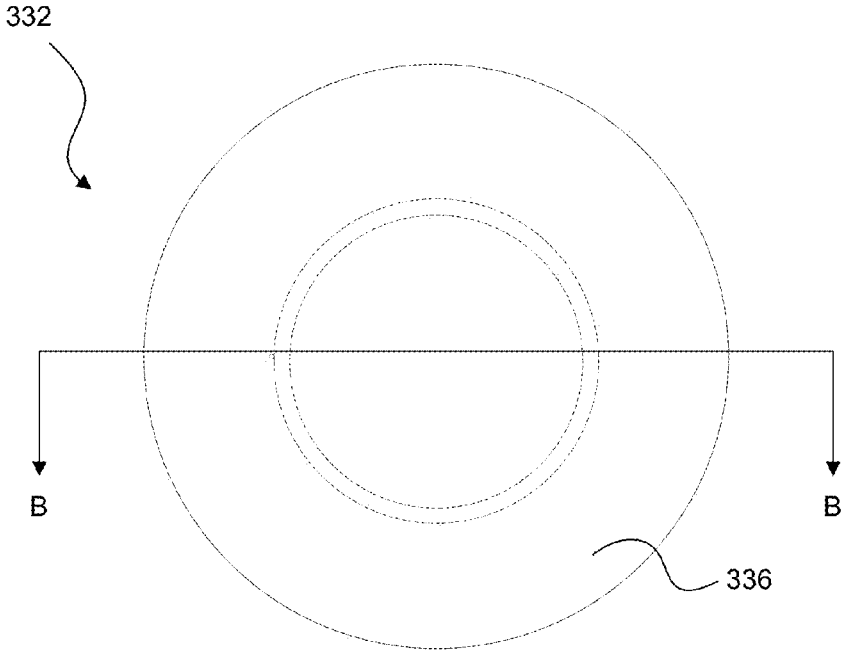
FIG. 3D is a top view of the exterior grip portion of FIG. 3B according to at least some examples of this invention.

FIG. 3D is a top view of the interior grip portion 332. The top portion of the grip 330 may include a grip cap 336 that may be formed of the same or similar material as the interior grip member 332. In some arrangements, the grip cap 336 may be formed of a material different from either the interior grip member 332 or the exterior grip portion 334. In some examples, the grip cap 336 may be integrally formed with one or more portions of the grip 330, such as the interior grip member 332. Alternatively, the grip cap 336 may be formed separately from the remainder of the grip 330 and connected to the grip 330 using known methods of connection, such as adhesives, cements, mechanical fasteners, snap fits, friction fits, and the like.

Figure 3E:
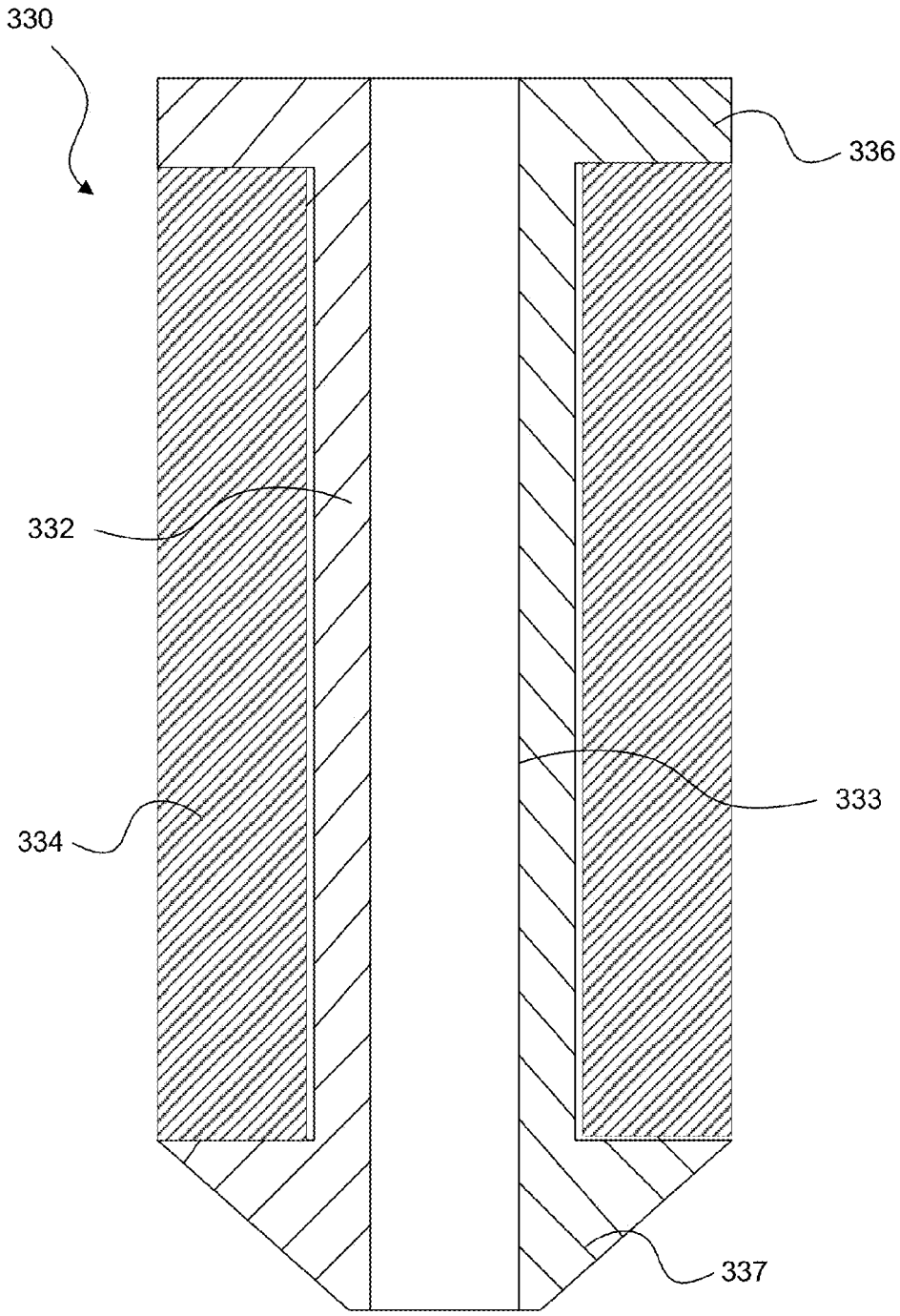
FIG. 3E is a cross-sectional view of the grip of FIG. 3A taken along line B-B in FIG. 3D and illustrating the grip being formed of multiple materials according to at least some examples of this invention.

FIG. 3E is a cross-section of the grip 330 taken along line B-B in FIG. 3D. The cross-section further illustrates the grip 330 arrangement including an interior grip portion 332 and an exterior grip member 334 around the interior grip member 334. In some arrangements, the interior grip member 332 may have a substantially circular cross-section and/or may have an open top arrangement, as shown in FIG. 3E. The exterior grip member 334 may then, in some arrangements, surround all or substantially all of the interior grip portion 332 in order to provide a comfortable grip surface for a player. For instance, the exterior grip member 334 may surround the central region 333 of the interior grip member 332 to provide a contact surface for a user during play. The arrangement shown illustrates the exterior grip member 334 as surrounding the central region 333 and covering all or substantially all of the central region 333. However, in some examples, the exterior grip member 334 may extend partially along the length of the central region 333. In these examples, the interior grip member 332 may remain exposed along the length not covered by the exterior grip member 334 or another grip portion may be included to cover the exposed portion of the interior grip member 332.

As discussed above, the interior grip member 332 may be formed of a material harder than the exterior grip member 334. In some examples, the interior grip member 332 may be formed of a recycled material, such as regrind, while the exterior grip member 334 may be formed of a softer polymer material that is optionally newly fabricated. This arrangement not only provides the advantages discussed above of a hard undersurface with a softer contact surface for the user, but also provides the additional advantages associated with using recycled materials, such as reduced waste, cost savings by using more scrap materials that would have been discarded in place of new, first-use materials, etc. The exterior grip member 334 may be formed of any of various materials, including natural or synthetic rubber, leather, polymeric materials, and the like.

Figure 4:
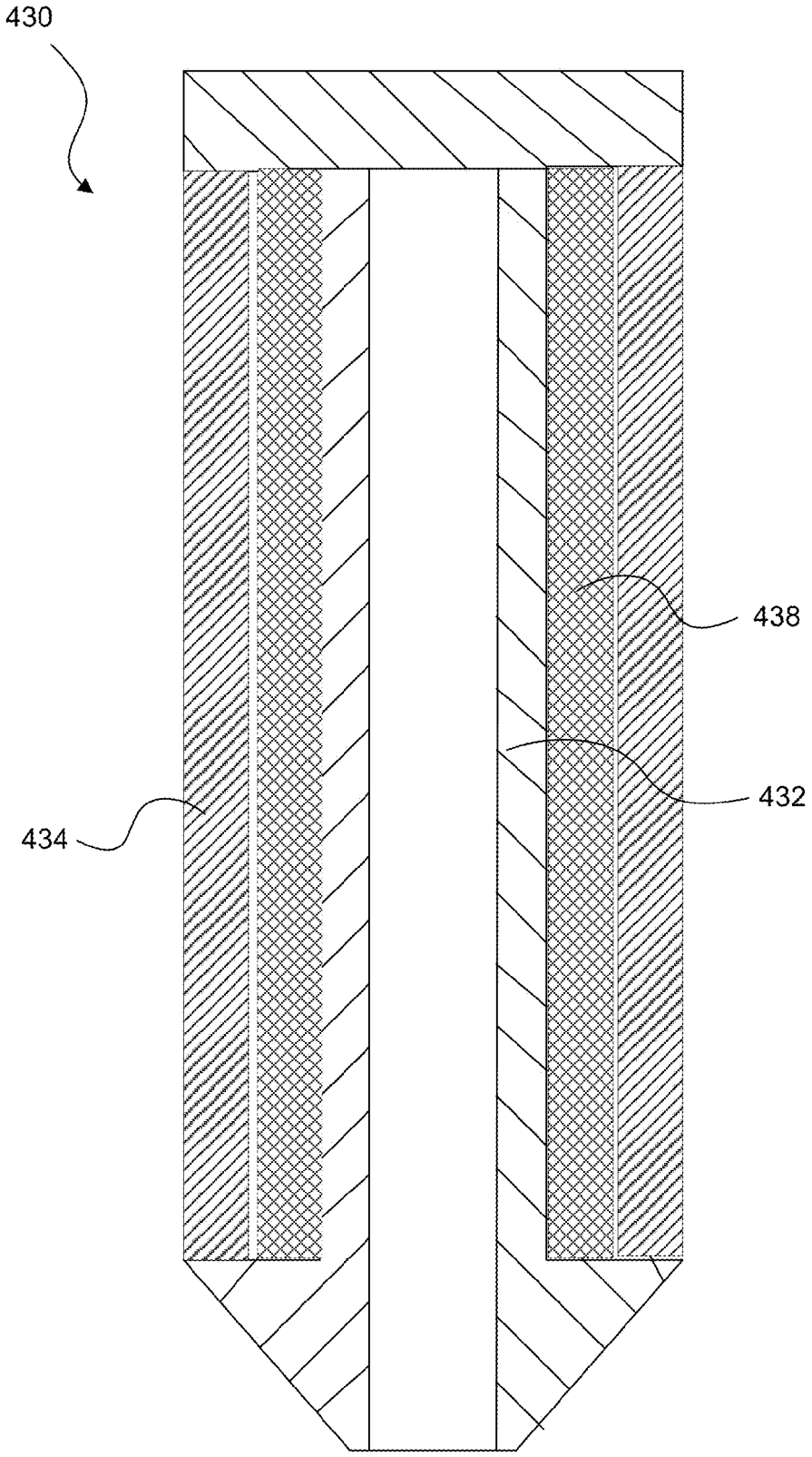
FIG. 4 is a cross-sectional view of another example grip formed of multiple materials according to at least some examples of this invention.

The grip 330 illustrated in FIGS. 3A-3E includes a single layer of softer, exterior grip material surrounded the interior grip member 332. However, in some arrangements, multiple layers of materials may be used. FIG. 4 illustrates one example grip 430 in which multiple layers of material are used in forming the grip 430. For instance, FIG. 4 illustrates a cross section of grip 430 and includes an interior grip portion 432 and an exterior grip portion 434 (e.g., similar to the structures and materials shown in FIGS. 3A-3E). Between the interior grip portion 432 and exterior grip portion 434 may be one or more additional grip layers, such as layer 438. These additional interior grip layers 438 may be formed of the same or substantially similar material as either the material forming the interior grip portion 432 or the exterior grip portion 434. In some arrangements, the interior grip layer 438 may be formed of a material different from the material forming one or both of the interior grip portion 432 and exterior grip portion 434. Although only one inner grip layer 438 is shown, multiple layers (arranged radially and/or longitudinally) may be provided without departing from the invention. Additionally or alternatively, similar to the arrangement discussed above, the inner grip layer 438 may have a constant thickness along the grip or the thickness of the inner grip layer 438 may vary along the length of the grip 430. As shown in FIG. 4, the grip 430 may have a generally closed arrangement in which the top portion is covered or closed. Alternatively, the grip 430 may have an open top configuration similar to the one shown in FIG. 3E.

Figure 5A:
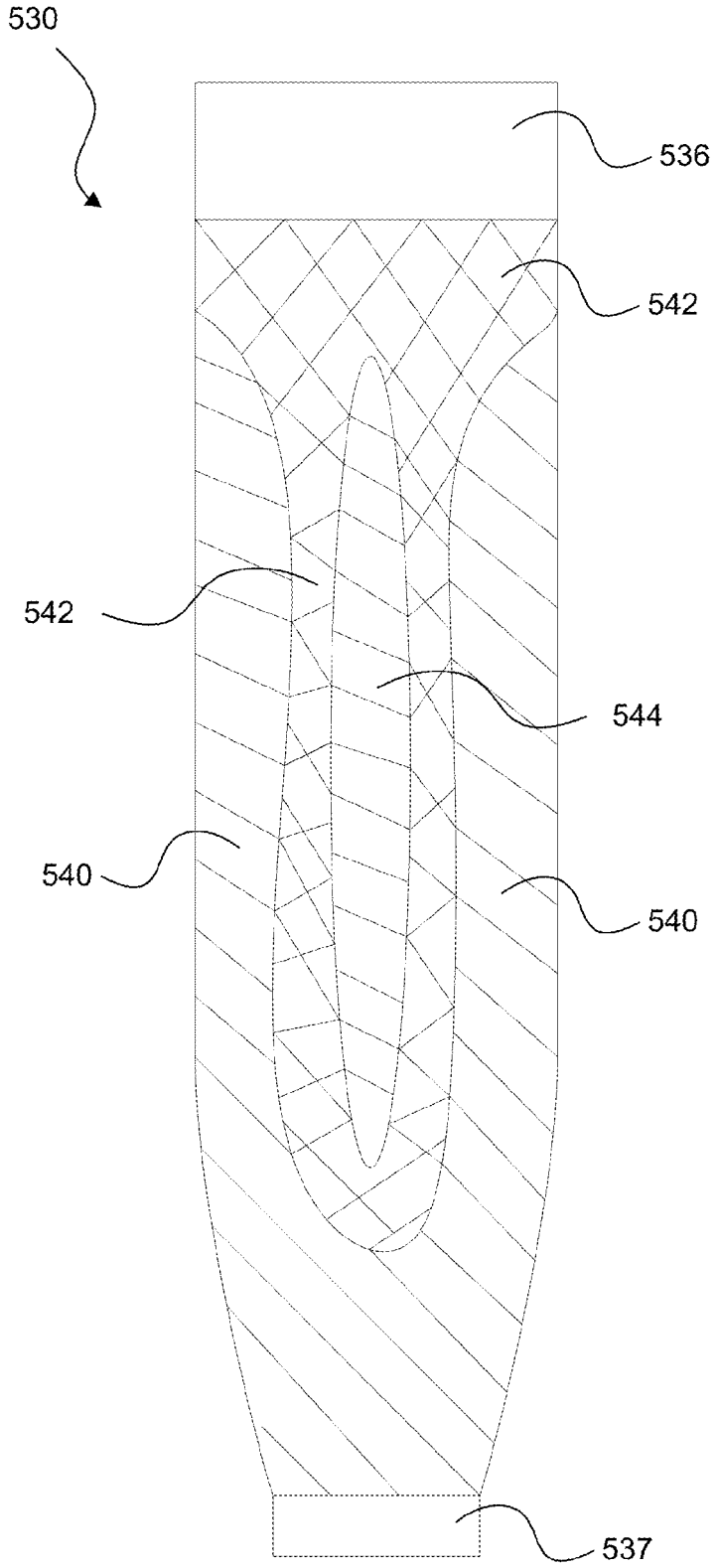
FIG. 5A is a front view of a grip arrangement including regions formed of different materials according to at least some examples of this invention.
Figure 5B:
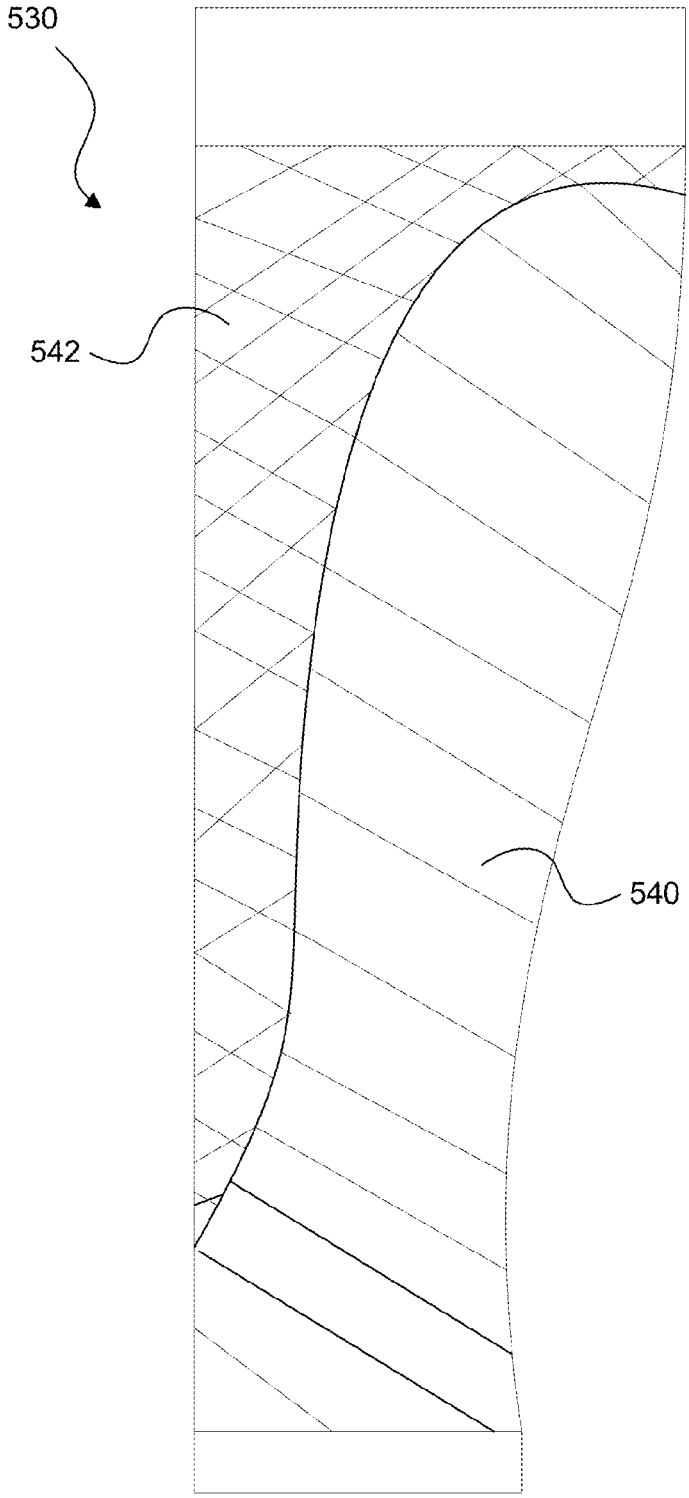
FIG. 5B is a side view of the grip of FIG. 5A according to at least some aspects of this invention.

FIGS. 5A-5B illustrate an alternate grip arrangement in which multiple materials, including recycled materials, may be used to form the grip 530, according to at least some aspects of this invention. The grip 530 includes multiple regions being formed of different materials. For instance, the grip 530 may include a top region, a bottom region and a central region extending between the top region and the bottom region. The central region may include regions that typically may be contacted by a user during play, and one or more of those portions or regions may be formed of a softer material than regions typically having minimal or no contact with the user during play. In some arrangements, a recycled material, such as regrind, may be used to form the harder regions of the grip 530, while another material, such as natural or synthetic rubber, leather, polymers, etc. may be used to form the regions having softer materials to provide better feel for user contact.

FIG. 5A illustrates a front view of this example grip 530. As shown, the grip 530 includes multiple grip regions, as indicated by different cross hatching in the figure. The various regions may be formed from different materials. In addition, the grip 530 may include a grip cap 536 and a bottom portion 537 configured to transition from the grip 530 to the shaft (not shown).

The multiple regions formed of different materials that comprise the grip 530 may be a combination of materials having varying hardnesses in order to provide a sturdy grip while also providing a comfortable exterior surface for a user to handle. For instance, region 540 forms a substantial portion of the front of the grip 530 and may be formed of a soft material that may provide a comfortable gripping surface for a user. Region 542 may form a portion of the grip 530 that has minimal contact with a user. Accordingly, this region may be formed of a harder material (i.e., having a greater shore value). Region 544 may generally be formed near a center of the front of the grip 530 and may, in some examples, be formed of the softer material, similar to region 540, because the front of the grip 530, and in particular the center region of the front of the grip 530, may have substantial contact with the user during play. Alternatively, region 544 may be formed of a material different from the materials forming region 540 and/or region 542. The juxtapositioning of harder and softer regions can provide a comfortable yet stable feel as the grip is handled.

In some examples, the harder material (such as that forming region 542) may be a recycled material, such as regrind, while the softer material (such as that forming region 540) may be a polymeric material, for instance thermoplastic polyurethane. As discussed above, this combination of recycled materials and new, first-use materials may aid in reducing waste associated with manufacturing, lower manufacturing costs, and the like. In some examples, the regions formed of the softer material, such as region 540, may form a majority of the surface of the grip, or of the central region of the grip.

FIG. 5B illustrates a side view of the grip 530 shown in FIG. 5A. As shown, region 540 may extend substantially around the circumference of the grip 530 and may comprise a majority of the upper rear portion of the grip 530, for instance, where the palms of a user may grip the club. Region 542 may generally extend around a top portion of the grip where, generally speaking, contact with the user is minimal. Accordingly, this arrangement provides a combination of stiff, hard materials to provide a sturdy structure for the grip 530, as well as softer materials to provide a comfortable grip for a user. The harder region 542 may also provide an interior chamber for receiving the shaft (e.g., like shown in FIGS. 3A-3E). Alternatively, if desired, the shaft receiving portion of the grip 530 may be one or more separate parts from regions 540 and 542, and this shaft receiving portion may be made, at least in part, from a regrind material.

Figure 6:
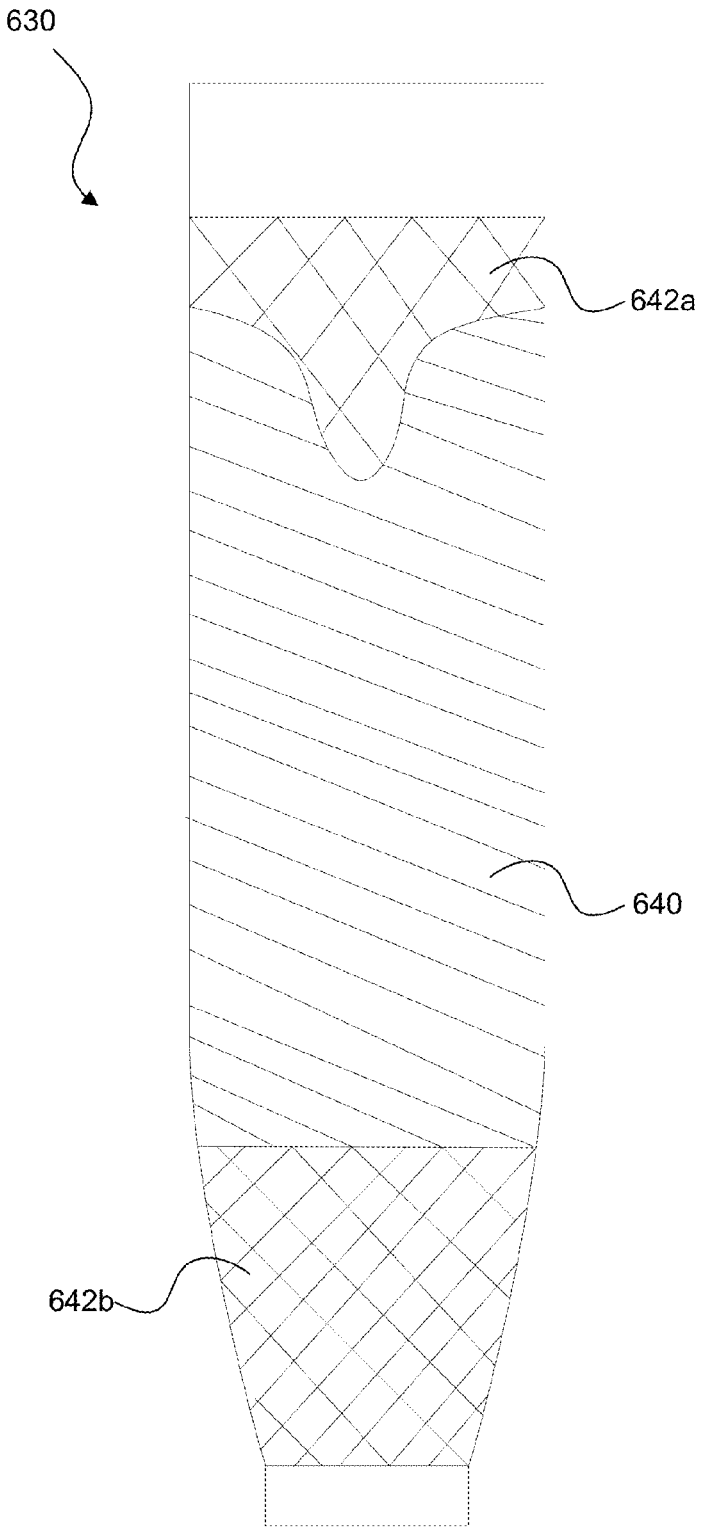
FIG. 6 is a front view of an alternate grip arrangement including regions formed of different materials according to at least some examples of this invention.

The multi-region grip arrangement shown in FIGS. 5A and 5B is merely one example arrangement of using multiple materials in different grip regions. The size, shape, configuration, etc. of each region may vary greatly without departing from the invention. For instance, FIG. 6 illustrates an alternate arrangement of a grip 630 having multiple regions formed of different materials. The grip 630 includes region 640 which may, in some examples, extend entirely around the grip 630. In other examples, regions 640 may extend partially around the grip 630. In addition, grip 630 may include region 642*a* and 642*b* arranged at a top and bottom of the grip, respectively. These regions 642*a*, 642*b* may be arranged around the entire grip 630 or partially around the grip 630.

Similar to the arrangement discussed above, the various regions 640, 642*a*, 642*b* of the grip 630 may be formed of different materials. For instance, region 640, with which the user may have substantial contact during use of the club, may be formed of a soft material, including various polymeric materials (e.g., thermoplastic polyurethane) to provide a comfortable, soft exterior surface. Further, a user may have minimal contact with the grip 630 in regions 642*a* and 642*b* and, thus, those regions may be formed of a harder (i.e., greater hardness value) material than region 640 in order to aid in providing a firm structure to the grip. Regions 642*a*, 642*b* may, in some examples, be formed of a recycled material, such as regrind, to maximize use of materials used during manufacturing by minimizing waste, etc. The harder regions 642*a* and 642*b* may connect with one another, e.g., via a portion of the grip providing an interior chamber for receiving the shaft (e.g., like shown in FIGS. 3A-3E). As another option, if desired, just one of harder regions 642*a* or 642*b* may be formed contiguously with a shaft receiving portion of the grip. Alternatively, if desired, the shaft receiving portion of the grip 630 may be one or more separate parts from regions 640, 642*a*, and/or 642*b*, and this shaft receiving portion may be made, at least in part, from a regrind material.

Any desired polymeric material may be used for the various face and/or grip materials without departing from this invention, including thermoplastic or thermosetting polymeric materials, synthetic rubber type polymeric materials, etc., such as polyurethanes, vinyls (e.g., ethylvinylacetates, etc.), nylons, polyethers, polybutylene terephthalates, etc. These same types of materials also may be recycled and used to provide the regrind materials for this invention.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 6 may be used individually and/or in any combination or subcombination without departing from this invention.

What is claimed is:

1. A golf club grip, comprising:

a first grip layer forming a base for the golf club grip, the first grip layer being formed of a recycled regrind material, the first grip layer forming part of an exterior surface of the grip;

a second grip layer in contact with the first grip layer, the second grip layer being arranged on an exterior surface of the first grip layer and forming part of the exterior surface of the grip, the second grip layer being formed of a second material having a lower hardness value than the recycled regrind material, wherein the second grip layer forms a majority of an upper rear portion of the exterior surface of the grip and is configured to engage palms of a user when gripping the club; and a third grip layer in contact with the first grip layer, the third grip layer forming part of the exterior surface of the grip and being formed of a third material having a lower hardness value than the recycled regrind material, wherein the third grip layer forms at least a portion of a center of a front of the exterior surface of the grip and is configured to engage a thumb of the user when gripping the club, and wherein the third grip layer is completely separated from the second grip layer on the exterior surface of the grip by the first grip layer.

2. The golf club grip of claim 1, wherein at least portions of the first grip layer have a substantially circular cross section and the first grip layer further includes a top portion, a bottom portion and a central portion.

3. The golf club grip of claim 2, wherein the second grip layer surrounds the central portion of the first grip layer.

4. The golf club grip of claim 1, wherein the second grip layer wraps around a portion of the first grip layer.

5. The golf club grip of claim 1, wherein the second grip layer forms a majority of a surface of the grip contacted by a user.

6. The golf club grip of claim 1, wherein the second grip layer is formed of at least one of natural rubber, synthetic rubber, leather, and polymeric materials.

7. The golf club grip of claim 1, wherein the third material is different from the first material.

8. The golf club grip of claim 7, wherein the third material is different from the second material.

9. The golf club grip of claim 1, wherein the first grip layer contains a cavity.

10. The golf club grip of claim 9, wherein the third grip layer fills at least a portion of the cavity.

11. A golf club, comprising:

a golf club head;

a shaft engaged with the golf club head; and a golf club grip of claim 1 engaged with the shaft.

12. A golf club grip having a top region, a bottom region and a central region extending between the top region and the bottom region, the golf club grip comprising:

a first grip region forming a first portion of the central region, the first grip region being formed of a first material and forming a majority of a surface of the central region, and wherein the first grip region contains a cavity;

a second grip region forming a second portion of the central region and forming a portion of the surface of the central region, the second grip region being formed of a second material different from the first material, wherein the second material is a recycled regrind material, and wherein the first material has a lower hardness than the recycled regrind material; and a third grip region forming a third portion of the central region and forming at least a front-center portion of the surface of the central region configured to engage a thumb of a user when gripping the club, wherein the second grip region is arranged at least partially between the first grip region and the third grip region, and wherein the third grip region has a lower hardness than the recycled regrind material.

13. The golf club grip of claim 12, wherein the first grip region extends around the golf club grip from a rear side of the golf club grip to a front side of the golf club grip.

14. The golf club grip of claim 12, wherein the top region and the bottom region are formed of the second material.

15. The golf club grip of claim 12, wherein the first grip region is arranged on an area of the golf club grip contacted by a user.

16. The golf club grip of claim 12, wherein the first material is at least one of natural rubber, synthetic rubber, leather, and polymeric materials.

17. The golf club grip of claim 12, wherein the third grip region is formed of third material different from the first material and the second material.

18. The golf club grip of claim 12, further including a third grip region forming a third portion of the central region, the third grip region being formed of the first material.

19. The golf club grip of claim 18, wherein the third grip region is positioned at a front surface of the golf club grip and is surrounded by the second grip region.

20. The golf club grip of claim 12, wherein the third grip region fills at least a portion of the cavity.

21. A golf club, comprising:

a golf club head;

a shaft engaged with the golf club head; and a golf club grip of claim 12 engaged with the shaft.

* * * * *